US009052176B1

(12) United States Patent
Stefano

(10) Patent No.: US 9,052,176 B1
(45) Date of Patent: Jun. 9, 2015

(54) SHELL CASING MARKER

(71) Applicant: Joseph Stefano, Wethersfield, CT (US)

(72) Inventor: Joseph Stefano, Wethersfield, CT (US)

(73) Assignee: Joseph Stefano, Wethersfield, CT (US)

( * ) Notice: Subject to any disclaimer, the term of this patent is extended or adjusted under 35 U.S.C. 154(b) by 0 days.

(21) Appl. No.: 14/216,716

(22) Filed: Mar. 17, 2014

Related U.S. Application Data

(60) Provisional application No. 61/799,832, filed on Mar. 15, 2013.

(51) Int. Cl.
*F42B 33/14* (2006.01)

(52) U.S. Cl.
CPC ..... *F42B 33/14* (2013.01)

(58) Field of Classification Search
CPC ..... F42B 33/14; B05C 1/022; B05C 9/022; B05D 1/26; B05D 2254/02
USPC ..... 86/19.7, 19, 1.1; 118/DIG. 11; 101/38.1, 101/DIG. 39
See application file for complete search history.

(56) References Cited

U.S. PATENT DOCUMENTS

| | | | | | |
|---|---|---|---|---|---|
| 1,322,271 | A * | 11/1919 | Thompson | 86/19 |
| 2,547,548 | A * | 4/1951 | Turner | 86/19 |
| 2,596,176 | A * | 5/1952 | Scherer | 427/2.22 |
| 3,358,644 | A * | 12/1967 | Greene | 118/219 |
| 4,563,935 | A * | 1/1986 | Rinck et al. | 86/17 |
| 4,893,542 | A * | 1/1990 | Aluotto | 86/19 |
| 5,317,967 | A * | 6/1994 | Heidenreich | 101/38.1 |
| 6,209,459 | B1 * | 4/2001 | Kaufman et al. | 102/439 |
| 6,616,974 | B1 * | 9/2003 | Lorig et al. | 427/271 |
| 7,032,492 | B2 * | 4/2006 | Meshirer | 86/43 |
| 2013/0333547 | A1 * | 12/2013 | Newman | 86/19.5 |

* cited by examiner

*Primary Examiner* — Bret Hayes
(74) *Attorney, Agent, or Firm* — Day Pitney, LLP

(57) ABSTRACT

A device for marking the external perimeter of ammunition. The device includes an outer case with an interior portion which includes a plurality of circular rollers that are position to create a recessed channel for ammunition to be placed into. The outer case is equipped with a crank, which is attached to a spindle, which controls the rotation of the circular rollers. One 360-degree rotation of the crank rotates the spindle and the ammunition. The outer case includes a lever attached to an external side of the outer case. The lever is attached to a holder which holds a plurality of marking instruments. When the lever is depressed, the holder and the marking instruments are lowered on to the external perimeter of the ammunition. While the ammunition is rotated, the marking instruments mark the external perimeter of the ammunition. After marking, the ammunition is ejected through the openings in the outer case which are aligned with the recessed channel.

9 Claims, 7 Drawing Sheets

SHELL CASING MARKER

CROSS-REFERENCE TO RELATED APPLICATION

The present patent application claims the benefit of priority to U.S. Provisional Patent Application 61/799,832 filed on Mar. 15, 2013. The aforementioned patent application is incorporated herein by reference in its entirety for any purpose whatsoever.

BACKGROUND

1. Field of the Disclosed Embodiments

The present application relates to a device used for marking shell casings or ammunition.

2. Background of the Disclosure

The recent changes in the sport of shooting has increased the cost of reloading components and decreased the supply of these items. Participants in handgun shooting sports often reload their own ammunition and know how frustrating and time consuming it is to collect their brass, ammunition, shell casings or bullets after a day at the range or participating in a competitive shooting event. Until now, the most popular way to identify one's brass from all the others on the ground was to mark the bottom of the brass with a colored line applied with a Sharpie®. The problem with this type of identification is that the marking can't be seen until the brass is picked up from the ground along with brass belonging to other shooters. The present application solves this problem.

SUMMARY OF THE DISCLOSED EMBODIMENTS

Advantages of the present disclosure will be set forth in and become apparent from the description that follows. Additional advantages of the disclosure will be realized and attained by the methods and systems particularly pointed out in the written description and claims hereof, as well as from the appended drawings.

The present disclosure relates to a device for marking the external perimeter of ammunition. The device includes an outer case with an interior portion which includes a plurality of circular rollers that are positioned to create a recessed channel for ammunition to be placed into. The outer case is equipped with a crank, which is attached to a spindle, which controls the rotation of the circular rollers. One 360 degree rotation of the crank rotates the spindle and the ammunition. The outer case includes a lever attached to an external side of the outer case. The lever is attached to a holding means which holds a plurality of marking instruments. When the lever is depressed, the holding means and the marking instruments are lowered on to the external perimeter of the ammunition. While the ammunition is rotated, the marking instruments mark the external perimeter of the ammunition. After marking, the ammunition is ejected through the openings in the outer case which are aligned with the recessed channel.

The present disclosure also relates to a method for marking the external perimeter of a shell casing of ammunition, including inserting marking instruments into a holding means; inserting ammunition into a recessed channel created by a plurality of circular rollers; depressing a lever to lower a holding means causing the marking instruments to come into contact with the ammunition; rotating a crank, which in turn rotates a spindle, which in turn rotates the plurality of circular rollers causing the ammunition to rotate while the marking instruments are in contact with the ammunition and causing the marking of the ammunition round with an identification marking around the external perimeter of the ammunition round; and ejecting the ammunition through the plurality of circular openings.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

DETAILED DESCRIPTION OF THE FIGURES

The disclosed shell casing marker device allows a user to draw a colored line around the circumference of the shell casing making it visible from every vantage point before a shooter picks it up off the ground. This will allow the user to identify and collect your ammunition, rounds or brass quicker and before it gets trampled into the ground. With the device, the shooters brass recovery rate should be near 90 to 100 percent.

Figure 1:
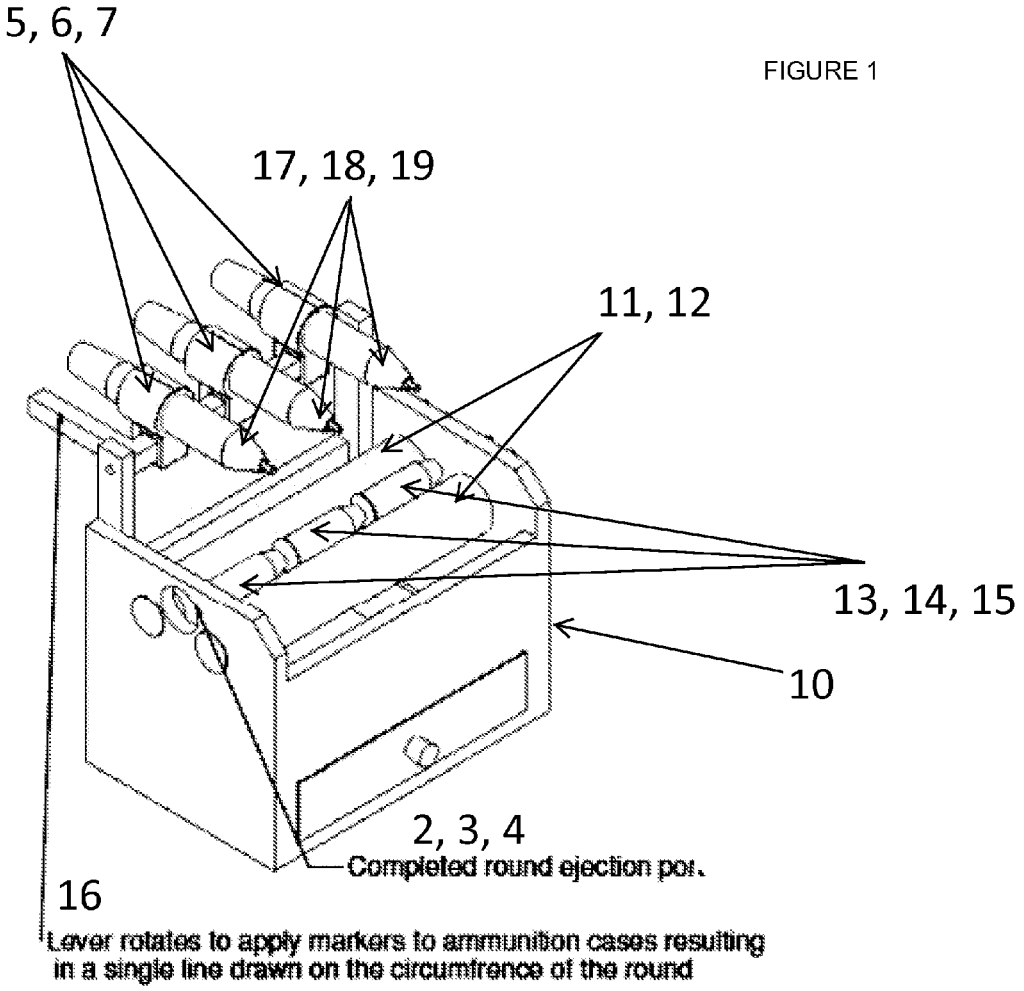
FIG. 1 is a left side view schematic of the device illustrating the marker lever.
Figure 2:
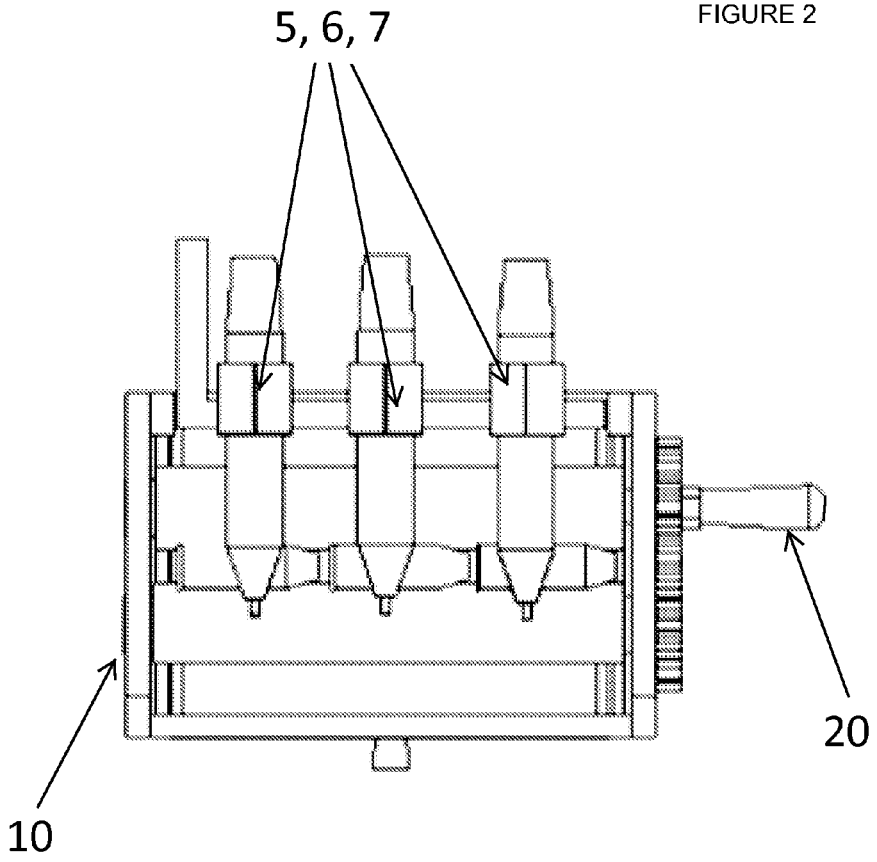
FIG. 2 is a top view schematic illustration of the device.

As shown in FIG. 1, the shell casing marker device 10 is a hand-operated two-roller device 11, 12, that allows a shooter to place three completed handgun rounds 13, 14, and 15 at a time on top of the two rollers 11 and 12. The rollers are made of plastic, and one of the rollers is covered with rubber. A user then rotates the marker lever 16 down until the Sharpie® 17, 18, or 19 (which are often referred to in the plural by their brand name Sharpie®) touches the external surface of the round. The user then hand turns the crank 20 on the right side of the device which is shown in FIG. 2. The device requires one revolution of the crank to draw a line around the circumference of the round. In another embodiment, the device, including the lever and the crank may be electronically, battery, machine or computer-controlled and operated. Once the rounds have been marked with the user's identifying colored line, the device may be tilted to the left side and the rounds will slide out of the openings 2, 3, and 4 on the external side of the shell casing marker device. In another embodiment, the device contains a motorized method for ejecting rounds that have been marked.

The shell casing marker device permits a user an opportunity to inspect the shell casing for deformities or irregularities. If the circumference of the shell casing contains splits, Glock bulge, unseated primers or other problems, damaged shell casing rounds will get stuck in the rollers, and the rollers will not be able to rotate. The Sharpie® (or other suitable marker) pen holders 5, 6, and 7 are adjustable to accommodate and mark various shapes and sized rounds including handgun and rifle caliber ammunition rounds. In other embodiments, the device can be larger and be equipped with additional rollers and can accommodate more shell casing rounds. Similarly, in larger devices, other types of marking instruments including marking instruments of varying shapes and sizes are used. FIG. 2 shows a top view of the illustrative device.

Figure 3:
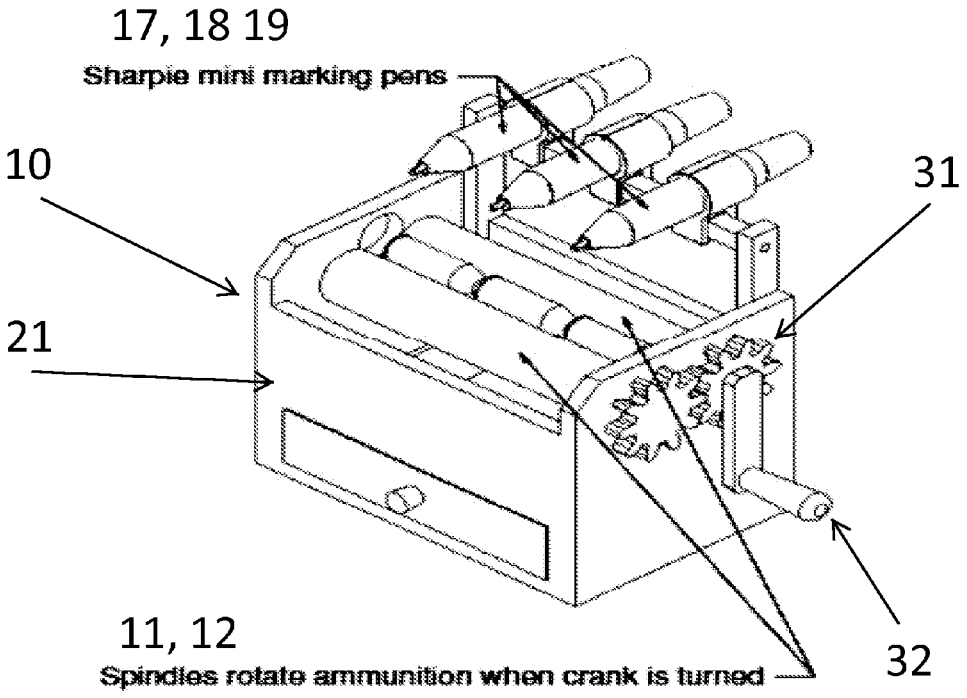
FIG. 3 is a right side view schematic of the device illustrating the spindle rotation crank.

As shown in FIG. 3, the device 10 includes a one-piece outer case 21 which can accommodate up to three markers 17, 18, and 19. The device 30 contains three marker holders 5, 6, and 7. The device includes two rollers 11 and 12 on the interior of the device. Handgun ammunition rounds 13, 14, and 15, also referred to as brass, are deposited on the double rollers 11 and 12. The double rollers can accommodate up to three handgun rounds, shell casings or ammunition. The rollers are connected to a rotating spindle 31 which is connected to a crank 32 located on the right side exterior of the device 10. The crank is turned by hand. In another embodiment, the crank may be electrically controlled or computer operated. In another embodiment, the rotating spindle is located on the interior portion of the device. In another embodiment, the device is covered by an outer shell when the device is not in use.

Once the rounds are placed safely on top of the rollers, a marker lever (as shown in FIG. 1), connected to the marker holders is depressed or rotated downward such that the tip of an uncapped marker touches the external surface of the loaded ammunition. Subsequently, the rotating spindle is cranked by hand causing the rollers to turn in a circular motion while the tip of the markers are against the ammunition. This allows for the external circumference of the ammunition to be marked by the tip of the uncapped marker. The device is configured such that it only requires one revolution of the crank to draw a single line around the circumference of each round. Once the rounds have been marked with the user's identifying colored line, the device is tilted to the left side and the marked ammunition will slide out of a rounded ejection port (as shown in FIG. 1).

Figure 4:
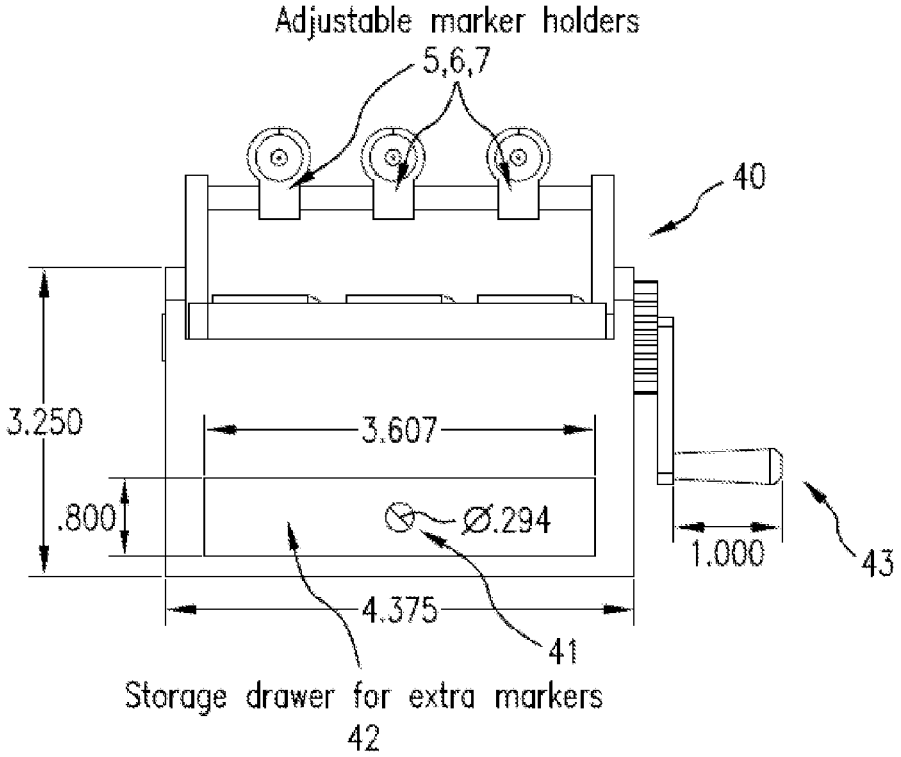
FIG. 4 is a front view schematic illustrating the measurements of the device.

As shown in FIG. 4, the marker holders 5, 6, and 7 of the device 10 are adjustable and can accommodate different sizes and thicknesses of markers. The device can hold mini- and micro-marking pens and markers as well as regular and oversized marking pens and markers. In another embodiment of the application, the device may be configured to accommodate different brands and sizes of markers. In addition, the device may be configured to accommodate more than three markers and thus contain additional marker holders. In another embodiment of the application, the device may be configured to contain less than three marker holders. Likewise, markers of different colors may be loaded into the marker holder. In another embodiment of the application, the marker holder can accommodate a marker whose permanent or semi-permanent ink adheres to ammunition and/or uses dyes or pigments as well as paint pens and colored liquid pens.

Figure 6:
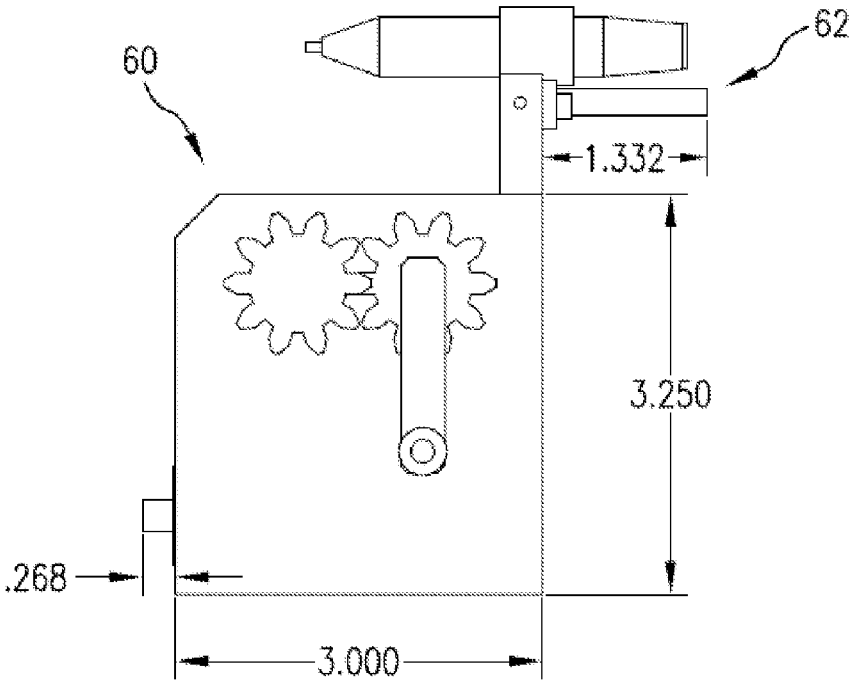
FIG. 6 is a left side view schematic of the device illustrating the measurements of the marker lever.
Figure 7:
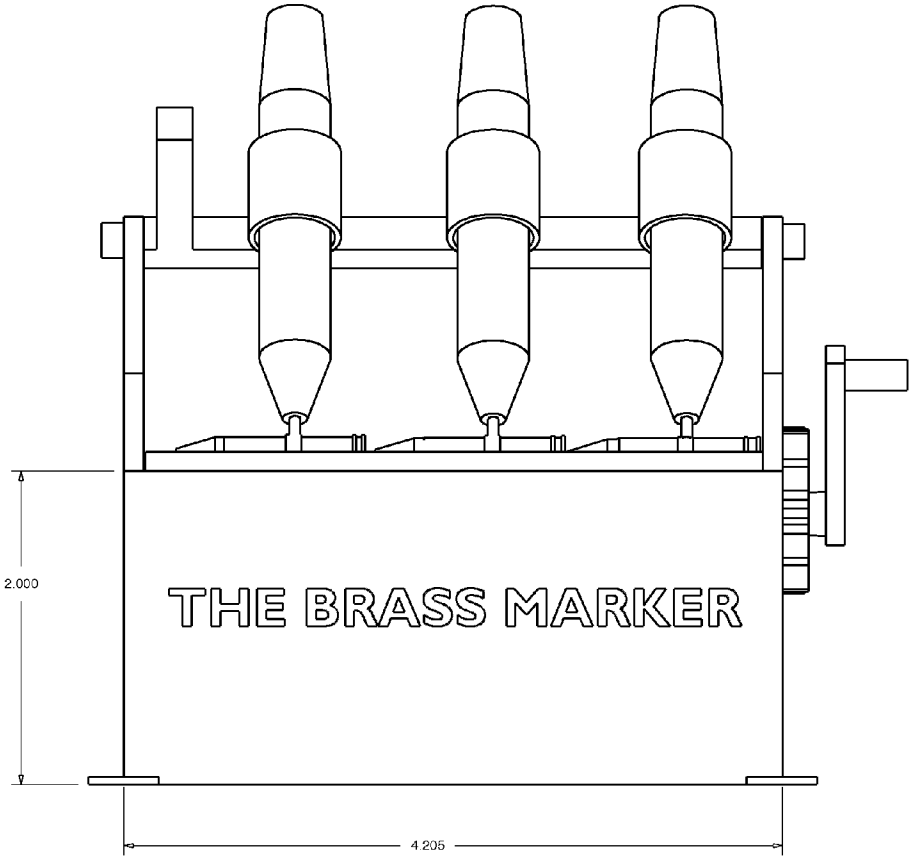
FIG. 7 is a schematic illustration of an alternative embodiment of the device.

As shown in FIG. 4, the measurements of the illustrated embodiment of the device 40 is 4.375" length wide by 3" wide by 3.25" in height (4.375"L×3"W×3.25"H). The device 40 includes a storage drawer 42 located on the front of the device 40 which can hold extra markers, pens or the caps from markers loaded into the marker holder. The storage draw is 3.67" long and 0.8" in height and includes a knob 41 with a diameter of 0.294" which is located 0.268" from the base of the device (as shown in FIG. 6). The handle of the crank 43 is 1" long. In another embodiment of the application, the device may be configured to be of larger measurements and able to accommodate additional markers and ammunition. In addition, the device may be adapted to a smaller size able to accommodate less than three bullets and less than three markers. In another embodiment, the device does not include a storage drawer (as shown in FIG. 7).

Figure 5:
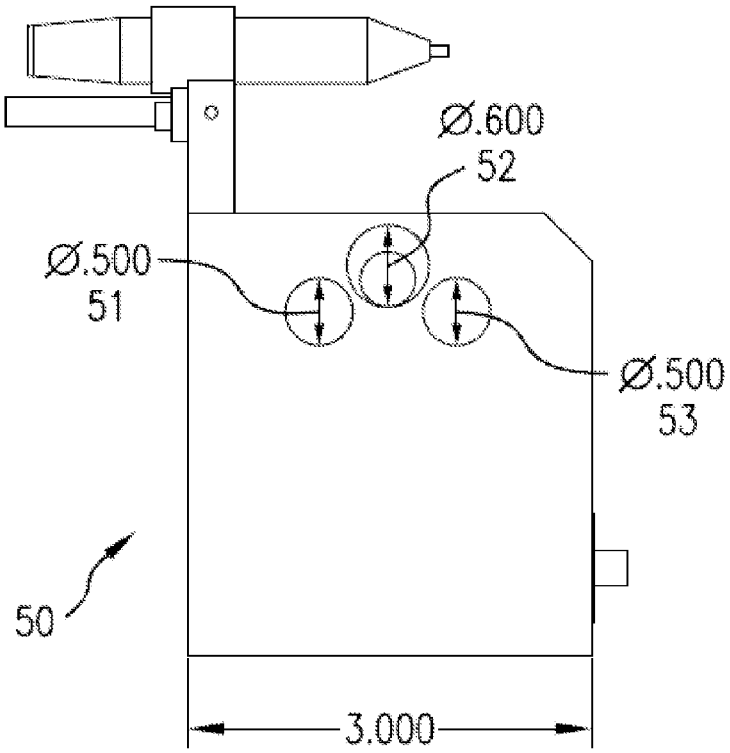
FIG. 5 is a right side view schematic of the device illustrating the measurements of the ammunition ejection port.

In FIG. 5, the round ejection openings or ports are shown. The device 50 has three round ejection ports 51, 52, and 53, each with a different circumference and each able to accommodate a different size round, bullet or brass. Once a round is marked by the marker, the device is titled until the round is ejected through the appropriately sized port. One of the ports has a diameter of 0.6". There are two other ports that have a diameter of 0.5". In another embodiment of the application, the device is configured to accommodate various sizes, diameters, and types of rounds and ammunitions that are used in a variety of guns. In the preferred embodiment of the device 60, as shown in FIG. 6, the marker lever 62 is shown with a length of 1.332". In another embodiment of the application, the marker lever is powered by electricity or battery operated. In another embodiment, the device may accommodate rifle ammunition. The device will be marketed and sold as The Brass Marker™.

Various other components may be included and called upon for providing for aspects of the teachings herein. For example, additional materials, combinations of materials and/or omission of materials may be used to provide for added embodiments that are within the scope of the teachings herein. In the present application, a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made, and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A device for marking an external perimeter of a shell casing of ammunition, including:

an outer case including an interior portion, said interior portion including a plurality of circular rollers configured to create a recessed channel for ammunition to be placed within; the plurality of circular rollers connected to a spindle which is connected to a crank; wherein rotation of the crank rotates the spindle and the ammunition; and wherein the outer case is adapted and configured with a lever, said lever being attached to a holder, the holder being configured to receive a plurality of marking instruments; and wherein depression of the lever lowers the holder and causes the marking instruments to be lowered such that the marking instruments are in contact with the external perimeter of the ammunition and the external perimeter of the ammunition is marked with an identification marking; and wherein the outer case includes a plurality of openings where individual rounds of the ammunition are ejected through and which openings are aligned to the recessed channel where the ammunition is placed within.

2. The device of claim 1 wherein the marking instruments includes at least one of a colored permanent marker.

3. The device of claim 1, wherein the holder is adjustable to receive a plurality of sizes of markers.

4. The device of claim 1, wherein sizes of individual openings of the plurality of openings correspond to sizes of rounds of ammunition.

5. The device of claim 1, wherein the device is battery operated.

6. The device of claim 1, wherein the device is manually operated.

7. The device of claim 1, wherein the crank and rotating spindle is located on an exterior side of the device.

8. The device of claim 1, further comprising a storage drawer.

9. A method for marking an external perimeter of a shell casing of ammunition, including:

inserting marking instruments into a holder;

inserting ammunition into a recessed channel created by a plurality of circular rollers;

depressing a lever to lower the holder to cause the marking instruments to come into contact with the ammunition;

rotating a crank, which in turn rotates a spindle, which in turn rotates the plurality of circular rollers causing the ammunition to rotate while the marking instruments are in contact with the ammunition and causing the marking of the ammunition round with an identification marking around the external perimeter of the ammunition round; and ejecting the ammunition through a plurality of circular openings.

* * * * *